United States Patent [19]

Keller

[11] Patent Number: 4,578,865

[45] Date of Patent: Apr. 1, 1986

[54] TILE CUTTING DEVICE HAVING PARALLEL BLADES

[76] Inventor: Jeffrey Keller, 2242 Blackhorse Dr., Warrington, Pa. 18976

[21] Appl. No.: 605,918

[22] Filed: May 1, 1984

[51] Int. Cl.[4] ..... B26B 3/00

[52] U.S. Cl. ..... 30/304; 30/162; 30/335

[58] Field of Search ..... 30/143, 152, 162, 304, 30/305, 335

[56] References Cited

U.S. PATENT DOCUMENTS 3,488,843 1/1970 Tims ..... 30/162

3,829,847 4/1975 Roll ..... 30/162

FOREIGN PATENT DOCUMENTS 1334383 10/1973 United Kingdom ..... 30/304

*Primary Examiner*—Douglas D. Watts

*Attorney, Agent, or Firm*—Joseph W. Molasky

[57] ABSTRACT

A device for forming a rabbet edge on ceiling tile consisting essentially of two blades held in parallel one in a fixed position and the remaining blade being slidable so that it may extend beyond the fixed blade to produce a deeper cut. The unwanted tile is first severed with the extended blade following which the shorter fixed blade is used to make a perpendicular cut and remove an unwanted longitudinal segment. The blades are replacable to provide fresh cutting edges.

4 Claims, 7 Drawing Figures

TILE CUTTING DEVICE HAVING PARALLEL BLADES

This invention relates to a cutting device for forming a rabbet-edge on acoustical ceiling tile. A "rabbet-edge" is a shiplap border which surrounds each tile piece and which overlaps a mirror-image of the same border on a companion tile. As a result, each tile flows smoothly one into the other because the respective edges are integrated into the ceiling design.

It is an object of this invention to provide a device comprised of two single edge blades which are employed in tandem to both sever unwanted segments of tile and introduce a rabbet-edge.

It is another object to provide a cutting device in which one of said blades is adjustable and can be extended to a length which is twice the length of the stationary blade. By virtue of this invention it is now possible to form a perfect rabbet-edge using a single tool. Moreover, the present device is safe to use, simple to operate and inexpensive to produce.

BACKGROUND

The rabbet-edge on ceiling tile is in the form of a recess which overlaps the companion recess of an abutting tile so as to cover the jointure more effectively. In addition, it provides support for each overlapping segment so as to hold the tiles more firmly in place.

Although ceiling tile is manufactured with a rabbet-edge it is often necessary during installation to conform same to the area which is to be covered as a result of which it is necessary to introduce a new edge.

Heretofore, several fresh-bladed knives were needed for this operation. Moreover, precise measurements were required so that the resulting tiles could be properly mated and thus provide a unitary appearance which avoided the old-fashioned block-look.

The present invention overcomes these difficulties by providing a tool with an adjustable blade for forming a perfect rabbet-edge in all instances.

THE INVENTION

The device of this invention is comprised of two single edge blades held in tandem in a spaced-apart relationship. Said blades are in a parallel mode so that identical cuts of equal depth can be made in a tile piece in a single stroke.

Following the initial cut the adjustable blade is extended to its maximum length to sever the unwanted tile portion. In this step the stationary blade, that is, the shorter of the two blades, is inserted into the innermost of the two cuts to guide the adjustable or extended blade in the severing operation.

After the tile has been severed the rabbet-edge is introduced by using the stationary or shorter blade to cut away a longitudinal segment of unwanted tile. In this step the adjustable blade is extended to its maximum length and it is laid sideways on the backside of the tile to serve as a guide for the stationary blade. Thereupon, the shorter blade is impressed into the tile perpendicular to the parallel cuts which were initially made and a longitudinal strip is removed in a single stroke. The result is a perfectly formed rabbet-edge which may be easily duplicated.

The cutting blades in the subject device are conventional single edge razor blades which may be easily replaced. These blades are durably constructed to withstand appreciable force and, therefore, they may be safely employed for their intended purpose.

Moreover, the blades of this invention are adjustable so that their respective cutting depths can be made shallow or deep depending upon the thickness of the tile which is to be cut. The simplicity of design also contributes to ease of disassembly for cleaning and repair purposes.

This invention will now be described with specificity from a mechanical standpoint following which reference will be made to the attached Drawings.

The present device is comprised of a handle, a blade-retaining body, two U-shaped clips, two single edge blades and a projection or knob by which to extend or withdraw the adjustable blade. The assemblage of these elements provides a cutting device which can be described as follows:

(1) a hollow handle having an interior longitudinal channel with a beveled opening at the front end and a longitudinal slot extending into said channel;

(2) a rectangular blade-retaining body having two opposing narrow surfaces and two upwardly extending parallel sidewalls within said channel;

(3) two generally U-shaped clips which are adapted to the surfaces and sidewalls of said blade-retaining body, the first clip being in a fixed relationship to said body and the second clip being slidable with respect thereto;

(5) means for adjusting said slidable blade to its desired cutting depth by impressing forward a projection which extends upwardly from the second clip through the slot in said handle.

The clip which holds the stationary blade, that is, the first clip, is secured to the blade-retaining body via a projection which extends into an opening or orifice in said body.

On the other hand, the slidable clip includes a flange which is tracked in a longitudinal channel in said blade-retaining body. Bolt and nut means may be used to secure the handle to said body but it will be obvious to one skilled in the art that other means may also be employed without departing from the spirit or scope of this invention.

These and other features of the invention will be apparent by reference to the accompanying Drawings.

DETAILED DESCRIPTION OF THE PREFERRED EMBODIMENTS

Figure 1:
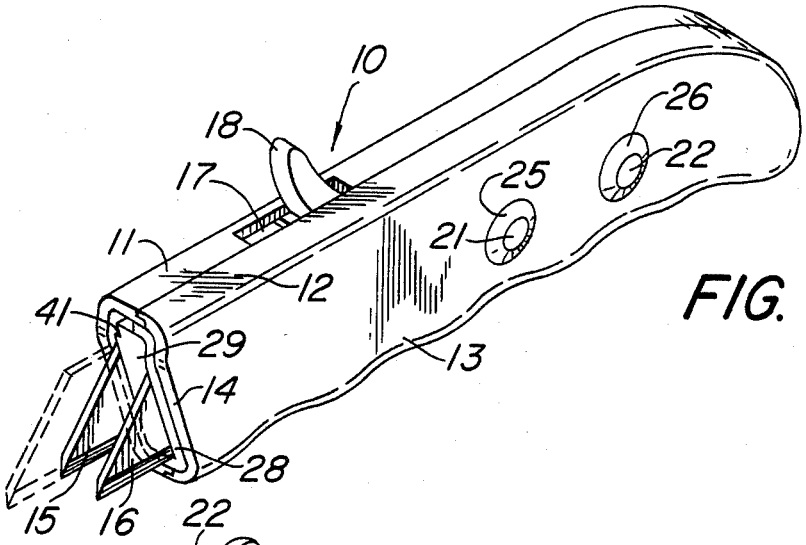
FIG. 1 is a perspective view of the present device.
Figure 2:
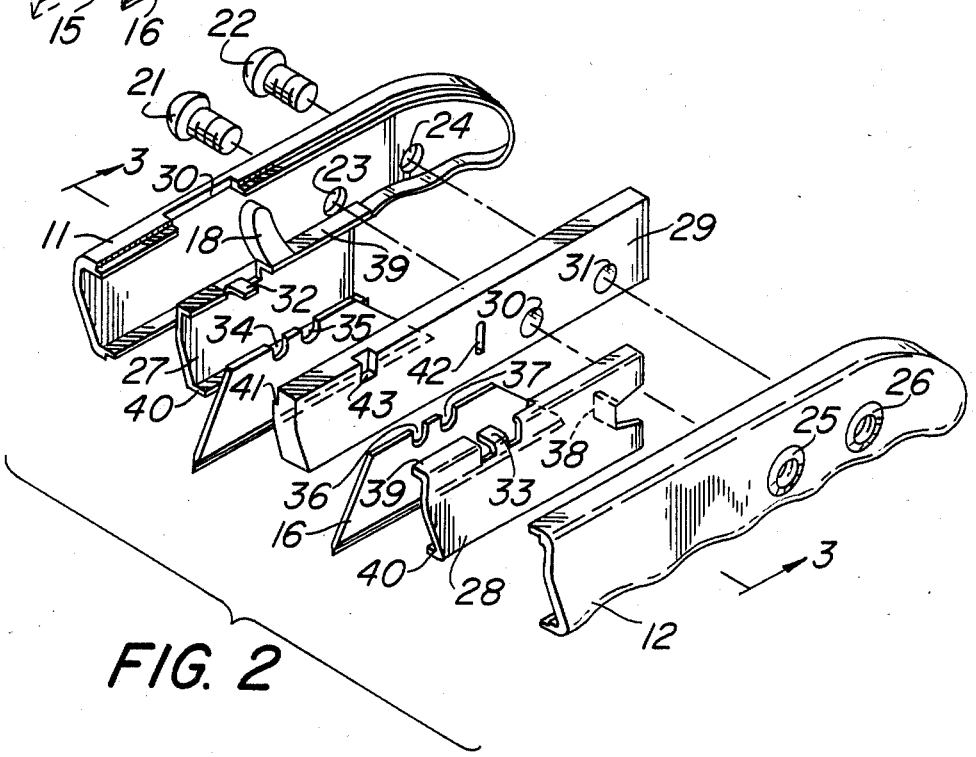
FIG. 2 is a perspective view of the device of FIG. 1 disassembled.

The device of this invention is shown generally as 10 in FIG. 1. The handle for this instrument is comprised of sections 11 and 12 which are held together by screws as shown in FIG. 2. The handle is depicted with finger-gripping curves 13 but it will be apparent to one skilled in the art that any configuration which is suitable for holding by hand may be employed.

The front end 14 of this device is tapered to provide maximum exposure for the cutting edge of blades 15 and 16.

Extending upwardly through the slotted opening 17 in said handle is a projection 18 which is adjoined to U-clip 27 and which cooperates with the slidable blade 15 in the manner hereinafter described. In FIG. 1 blade 15 is equal in length to blade 16 when projection 18 is in a rearward mode; however, the application of thumb pressure to the concave side of said projection will move it forward within said opening and simultaneously place blade 15 in an extended position. The fully extended position for blade 18 is shown in phantom in FIG. 1. To retract blade 15 the user simply exerts a rearward pressure upon projection 18 until blade 15 is returned to its original position.

In FIG. 2 the cutting device is shown in a disassembled mode to illustrate its internal mechanism. The handle 10 is comprised of two hollowed-out sections 11 and 12 between which are assembled two U-shaped clips identified as 27 and 28, blade holding body 29 and blades 15 and 16.

The handle section 11 includes a longitudinal cutout 30 which, in combination with section 12, forms the slotted opening 17 shown in FIG. 1. The entire assembly is held together by screws 21 and 22 which are brought into engagement first with apertures 23 and 24 of handle section 11, then with apertures 30 and 31 of the blade-retaining body 29 and, finally with the internally threaded apertures identified as 25 and 26 in handle section 12.

The blades 15 and 16 are held within their respective U-clips by flanges 39 and 40 and they are positioned therein by tabs which extend into cutouts at the top of each blade (FIG. 2). Several cutouts are provided so that each blade can be independently positioned to provide the desired cutting depth. Thus, in the case of blade 15 the tab 32 may be inserted into either cutout 34 or 35 and in the case of blade 16 tab 33 may be inserted into either cutout 36 or 37 to provide whichever cutting depth is desired. Blades 15 and 16 are spaced apart from one another by a distance which is approximately equal to the depth of cut of the rabbet edge. In most instances this distance will be $\frac{3}{8}$ inch but it will be appreciated by those skilled in the art that the distance may vary depending upon the thickness of the tile which is to be cut.

Figure 4:
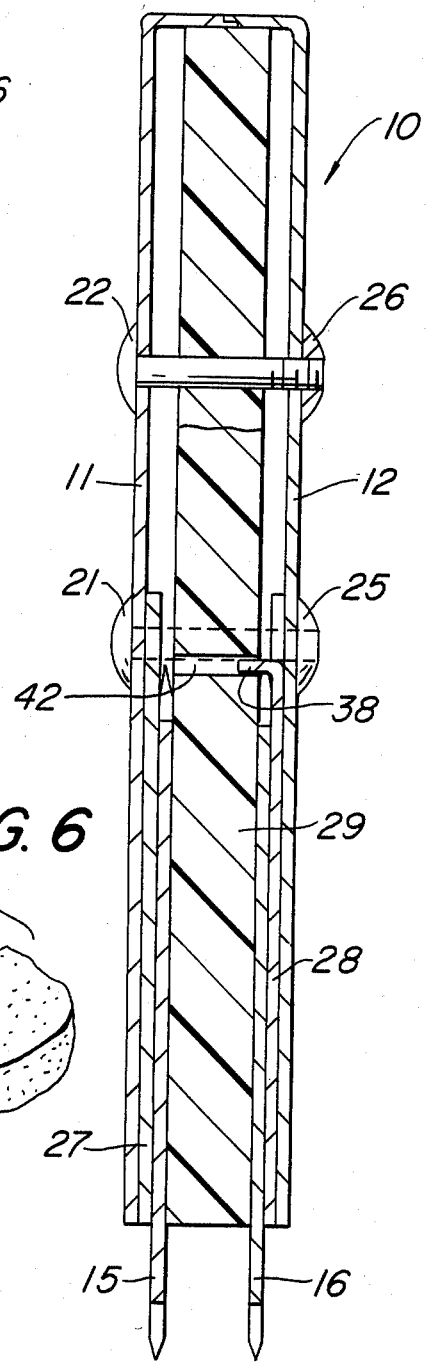
FIG. 4 is a sectional view taken along line 4—4 of FIG. 3.

After the blades have been inserted into their respective U-clips and they are properly positioned the blade-retaining body 29 is inserted between said blades to afford the sandwich-type arrangement shown in FIG. 4. As a result of this arrangement tab 38 of U-clip 28 is brought into a mated engagement with the accommodating orifice 42 so that said clip and said blade-retaining body are in a fixed relationship to one another.

Included within the blade-retaining body 29 is a cut-away portion 43 for receiving the portion of tab 33 which extends beyond the cutout in blade 16. The insertion of said tab into said cut-away ensures that blade 16 will remain in a fixed relationship with respect to the clip and body between which it is positioned.

Figure 3:
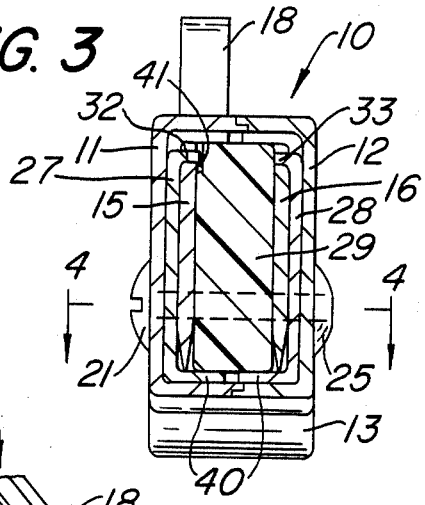
FIG. 3 is a front elevational view taken along line 3—3 of FIG. 2.

Also included within the blade-retaining body 29 is a longitudinal offset shown as 41 in FIG. 2. This offset provides a plane upon which tab 32 of clip 27 is slidably impelled when projection 18 is moved forward or rearward within the slotted opening 17. The relationship of tab 32 to said offset is shown with specificity in FIG. 3.

The present device will now be described by making reference to the method for forming a rabbet edge on ceiling tile.

Figure 5:
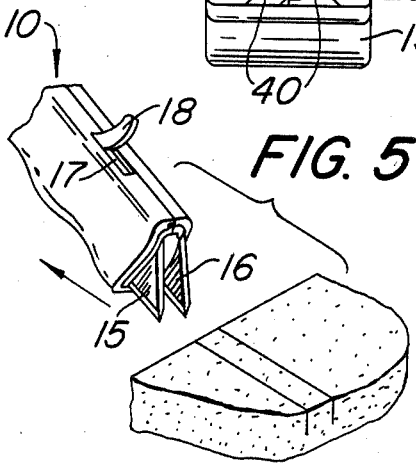
FIGS. 5–7 are fragmentary perspective views of the front portion of the present device shown in an operational mode.

In the initial step slidable blade 15 is placed in a retracted position so that it is equal in length to the fixed blade 16. The tile piece which is to be cut is placed on a firm surface face upwards and a straight edge is used to form a dual cut into the tile face as shown in FIG. 5.

Figure 6:
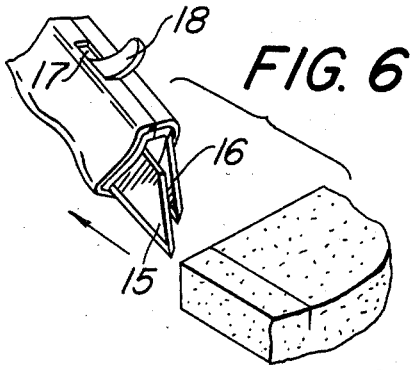

In the next step blade 15 is extended to its maximum length and the unwanted tile portion is severed. To assure an even cut blades 15 and 16 are placed into the dual track formed by the original cut and blade 15 is further impressed into the tile to sever the unwanted tile portion as shown in FIG. 6.

Figure 7:
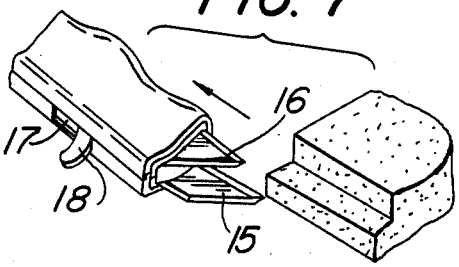

In the final step a perpendicular cut is made. In this operation the inner surface of blade 15 is placed in an extended position and its inner surface is allowed to rest against the backside of the tile where it serves as a guide for cutting blade.16. Thereupon, blade 16 is impressed into the tile and a longitudinal segment is cut away to form a uniform right angle recess or rabbet edge which compares favorably with commercially formed tile edges. This formation is depicted in FIG. 7.

The rabbeted tile thus formed can be employed in the conventional manner with other rabbeted tiles so that the lower edge of one overlaps the upper edge of another.

The device herein described and illustrated is intended for a righthanded operator but it will be appreciated by those skilled in the art that the blade assembly herein described can be juxtaposed to accommodate a lefthanded user. Accordingly, such modification is inherently covered by the present description and forms a part of the appended claims.

This invention has been illustrated by precise embodiments; however, it is also subject to variation and modification and to the extent that such changes are obvious they are also within the scope of this invention.

Having thus described my invention the following claims are presented.

What is claimed is:

1. A cutting device having two blades which are used to form a rabbet edge on acoustical tile which comprises:

(1) a hollow handle having an interior longitudinal channel with a beveled opening at the front end and a longitudinal slot extending into said channel;

(2) a rectangular blade-retaining body having two opposing narrow surfaces and two upwardly extending parallel sidewalls within said channel;

(3) two generally U-shaped clips which are adapted to the surfaces and sidewalls of said blade-retaining body, the first clip being in a fixed relationship to said body and the second clip being slidable with respect thereto;

(4) two single edge blades mounted in parallel on opposite sides of said blade-retaining body, one blade being mounted in said first clip and thus fixed to said body and he second blade being mounted in said second clip so that it is slidable with respect to said body;

(5) means for adjusting said slidable blade to its desired cutting depth comprising a projection which extends upwardly from the second clip through the slot in said handle to be impressed forward by the user.

2. The device of claim 1 wherein said first clip is secured to said blade-retaining body by a projection which extends into an orifice in said body.

3. The device of claim 1 wherein the slidable clip includes a flange which is tracked in a longitudinal channel within said blade-retaining body.

4. The device of claim 1 wherein said blade-retaining body is secured to said handle by screw means.

* * * * *